US007256707B2

(12) United States Patent
Clark et al.

(10) Patent No.: US 7,256,707 B2
(45) Date of Patent: Aug. 14, 2007

(54) RF TRANSMISSION LINE AND DRILL/PIPE STRING SWITCHING TECHNOLOGY FOR DOWN-HOLE TELEMETRY

(75) Inventors: David D. Clark, Santa Fe, NM (US); Don M. Coates, Santa Fe, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 237 days.

(21) Appl. No.: 10/872,054

(22) Filed: Jun. 18, 2004

(65) Prior Publication Data

US 2006/0227663 A1 Oct. 12, 2006

(51) Int. Cl.
*G01V 3/00* (2006.01)

(52) U.S. Cl. ..... 340/854.4; 340/854.5; 367/82; 455/41.2; 455/41.3; 455/106

(58) Field of Classification Search ..... 340/854.4, 340/854.5; 367/82; 455/41.2, 41.3, 106
See application file for complete search history.

(56) References Cited

U.S. PATENT DOCUMENTS 4,939,325 A * 7/1990 Wendel et al. ..... 200/552
6,434,372 B1 * 8/2002 Neagley et al. ..... 455/106
6,898,149 B2 * 5/2005 Hill et al. ..... 367/82

OTHER PUBLICATIONS

U.S. Appl. No. 10/187,025, filed Jun. 28, 2002, Scott Briles.

* cited by examiner

*Primary Examiner*—Albert K. Wong
(74) *Attorney, Agent, or Firm*—Milton D. Wyrick; Robert P. Santandrea

(57) ABSTRACT

A modulated reflectance well telemetry apparatus having an electrically conductive pipe extending from above a surface to a point below the surface inside a casing. An electrical conductor is located at a position a distance from the electrically conductive pipe and extending from above the surface to a point below the surface. Modulated reflectance apparatus is located below the surface for modulating well data into a RF carrier transmitted from the surface and reflecting the modulated carrier back to the surface. A RF transceiver is located at the surface and is connected between the electrically conductive pipe and the electrical conductor for transmitting a RF signal that is confined between the electrically conductive well pipe and the electrical conductor to the modulated reflectance apparatus, and for receiving reflected data on the well from the modulated reflectance apparatus.

10 Claims, 4 Drawing Sheets

RF TRANSMISSION LINE AND DRILL/PIPE STRING SWITCHING TECHNOLOGY FOR DOWN-HOLE TELEMETRY

The present invention generally relates to oil field exploration techniques, and more specifically to means for telemetering information relevant to the subterranean environment to the surface. This invention was made with Government support under Contract No. W-7405-ENG-36 awarded by the U.S. Department of Energy. The Government has certain rights in the invention.

BACKGROUND OF THE INVENTION

As the world's supply of petroleum continues to diminish, it is ever more important that the maximum amount of petroleum be recovered from well sites. An important part of this effort involves improving telemetering relevant information from the subterranean environment to the surface, so that the petroleum industry can more efficiently drill wells and manage the production from those wells. In this invention, the word "communication" is used interchangeably with the word "telemetry," and the word "data" is used interchangeably with the word "information."

Currently, most down-hole telemetry is accomplished through systems based on mechanically pulsing the drilling fluid, or alternatively, wire or optical fiber circuits that are subject to abrasion and frequent breaks in the deleterious environment encountered in the well bore. Wire systems are subject to abrasion and cutting in the well bore environment, which can lead to communication failures due to inter-wire contact or an interruption of the communication circuit. Either failure condition may require that the communication circuit and assembly must be brought back to the surface for repair. Unreliability in down hole data is unfortunate for several reasons. Primarily, it is the high cost and loss of productive time associated with having the to raise a pipe string to fix a broken communication circuit. Additionally, reliable, real-time telemetry of data from the drill head can lead to increased efficiency of drilling and production operations.

The present invention presents apparatus and method for accomplishing reliable down hole communication. This is accomplished with minimal alteration of normal drilling equipment and procedures.

SUMMARY OF THE INVENTION

In order to achieve the objects and purposes of the present invention, and in accordance with its objectives, a modulated reflectance well telemetry apparatus comprises an electrically conductive pipe extending from above the ground surface to a point below the surface inside an electrically conductive casing. In addition, an electrical conductor is located at a position a distance from the electrically conductive well pipe and extending from above the ground surface to a point below the surface. Modulated reflectance apparatus is located below the surface for telemetering well data. A RF transceiver located at the surface is connected between the electrically conductive pipe and the electrical conductor for transmitting a RF signal that is confined between the electrically conductive pipe and the electrical conductor to the modulated reflectance apparatus, and for receiving the signal modulated with well data and reflected by the modulated reflectance apparatus.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION

The present invention provides down hole data communication for wells. The invention will be most easily understood through reference to the drawings.

Figure 1:
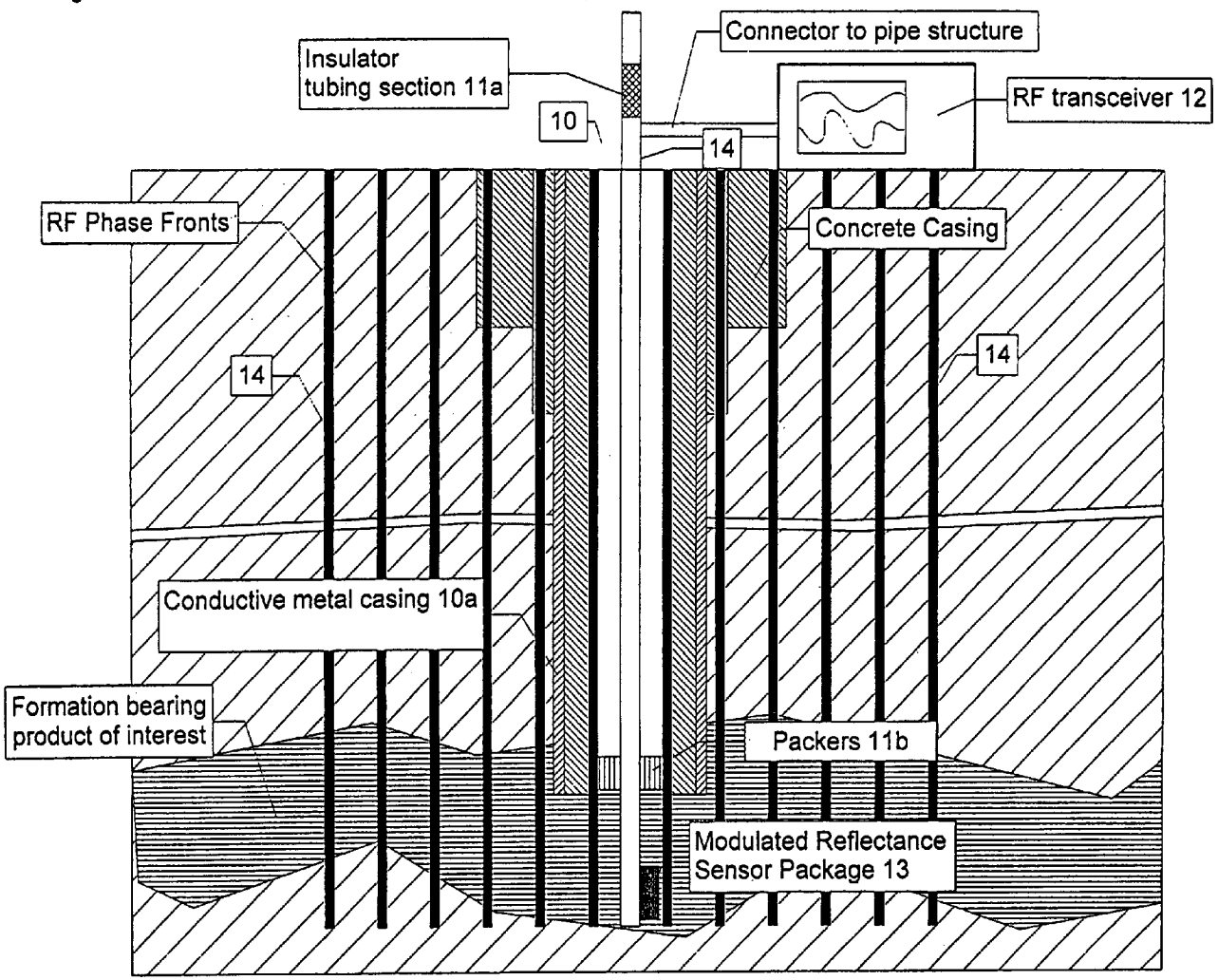
PRIOR ART Fig. 1
FIG. 1 is a cross-sectional schematic diagram of a drilled well having prior art modulated reflectance communication installed.

In FIG. 1, there can be seen a cross-sectional schematic illustration of a drilled well, labeled as prior art. The technology illustrated in FIG. 1 shows a prior use of modulated reflectance to communicate over the spatial extent of the well. As seen, well 10 is drilled into the earth and pipe string 11, surrounded by casing 10*a*, is in place to retrieve the desired substance. In many wells, casing 10*a* is electrically conductive. Pipe string 11 has insulator tubing section 11*a* to isolate the lower portion of pipe string 11 from the upper apparatus of well 10. Lower, pipe string 11 has packers 11*b* between pipe string 11 and casing 10*a*, packers 11*b* normally being made of cast iron. This means that in wells with cast iron packers and conductive casings, there exists an electrical connection between the pipe string and the conductive casing.

As seen RF transceiver 12, at the surface is coupled to pipe string 11, and to casing 10*a*, if it is conductive, which act as an antenna to pass a signal from RF transceiver 12 to modulated reflector sensor package 13 at some level below the ground surface. Modulated reflector sensor package 13 receives the signal and modulates it with well data as it is reflected back to the surface to RF transceiver 12. With virtually the entire length of pipe string 11 and an electrically conductive casing 10*a* functioning as an antenna, the RF energy from RF transceiver 12 is radiated into the surrounding geologic formation as shown by RF phase fronts 14. Of course, the more electrically conductive the formation, the greater the amount of RF energy lost. This problem could ultimately limit the depth to which modulated reflector sensor package 13 could be located for effective communication. This technology is more thoroughly described in U.S. patent application Ser. No. 10/187,025, filed Jun. 28, 2002, for "Remote Down-Hole Telemetry."

Figure 2:
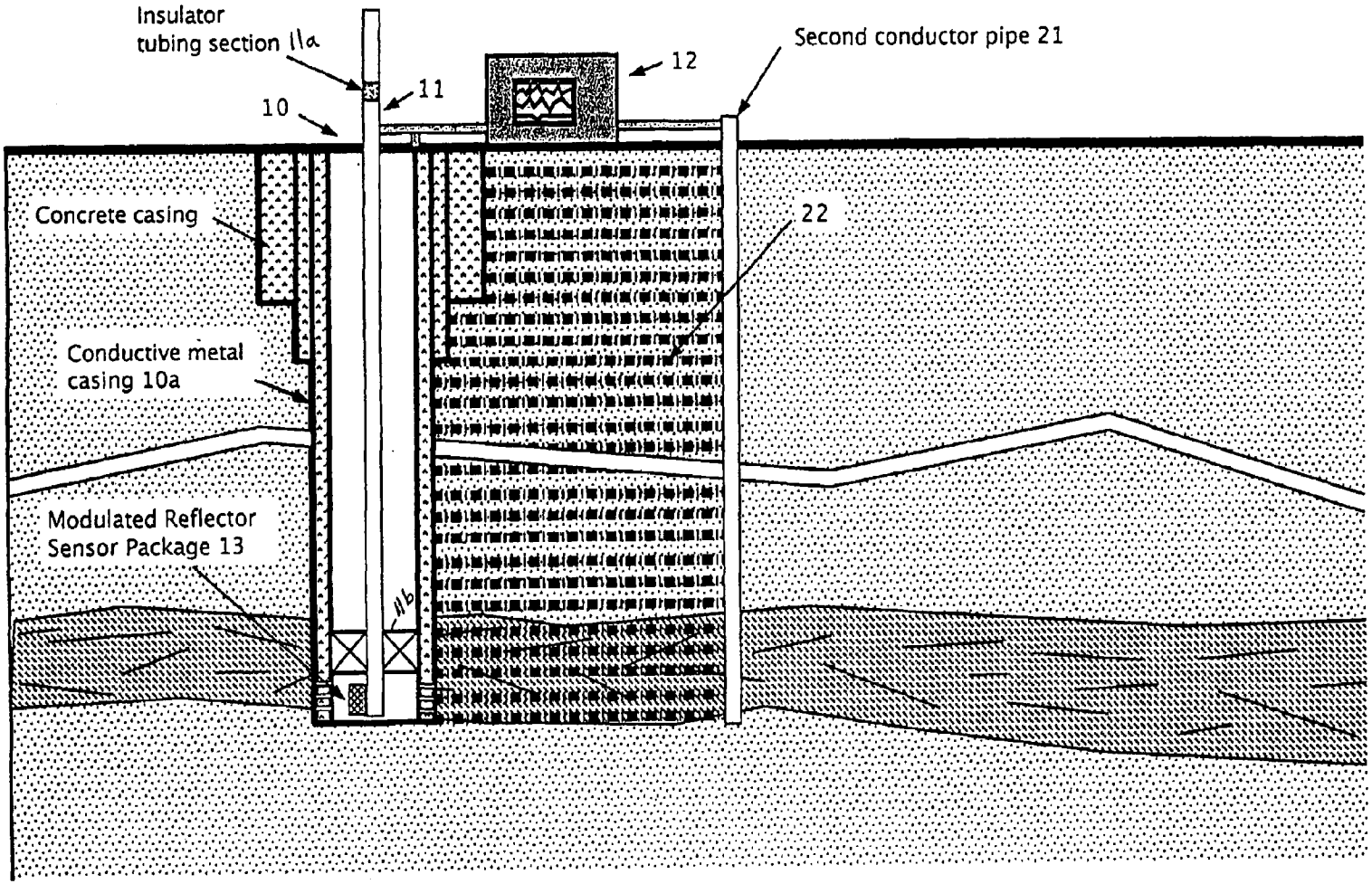
FIG. 2 is a cross-sectional schematic diagram of a drilled well having an embodiment of the present invention installed.

Referring now to FIG. 2, there can be seen one embodiment of the present invention. In this embodiment, electrical conductor 21, which could be, among other things, a pipe, a rod or cable, which can be relatively inexpensively inserted into the soil, perhaps by using a water well drilling apparatus. With RF transceiver 12 connected between pipe string 11 and casing 10*a*, if it is electrically conductive, and electrical conductor 21, RF phase fronts 22 are confined in the soil between pipe string 11, or a conductive casing 10*a* and electrical conductor 21. In this manner, modulated reflector sensor package 13, which could be located below casing 10*a*, receives a far greater amount of RF energy than with the prior art. In the appropriate situation, a nearby drill pipe from another well could serve as electrical conductor 21.

The transmission line created by pipe string 11 and an electrically conductive casing 10*a*, and electrical conductor 21 effectively confines radiation losses between these conductors. This is due to the fact that a transmission line performs as a guide for the RF energy and minimizes losses into its surrounding media. The radio and television broadcasting services exploit this property in order to move RF energy to antennas with high efficiency, as it prevents the loss of RF energy into undesired areas. Use of this property in the present invention results in the ability to receive telemetry from modulated reflector sensor package 13 being at greater depths in well 10 and with better fidelity. Also it is a feature of the present invention that the highly conductive "drilling mud" about well 10 enhances the effectiveness of the telemetry communication.

The present invention employs a unique embodiment of transmission line technology. In general, a transmission line is a tool for efficiently transporting radio frequency power, and can be constructed by placing two electrical conductors in arbitrary proximity to each other.

In the case of a two-wire transmission line, such as that used to connect an exterior antenna or rabbit ear antenna to a television set, two conductors of arbitrary diameter are placed a constant distance apart for the extent of the transmission line. A supply current is introduced on one of the conductors and to complete the electric circuit, the current appears as a return current of equal magnitude on the other conductor. The supply current generates a magnetic field that is equal in magnitude and opposite in direction of that generated by the return current. Corresponding electric fields are generated according to Faraday's law of electromagnetic induction. These fields are such that they cancel each other away from the conductors, but add together near the conductors. Due to the law of conservation of energy, all of the energy supplied by the current has to be contained in the electromagnetic field near the conductors. From this description, it can be understood that a transmission line, as is taught in the present invention, is a mechanism for conveying electromagnetic energy in fields spatially limited to be near the conductors.

Figure 3:
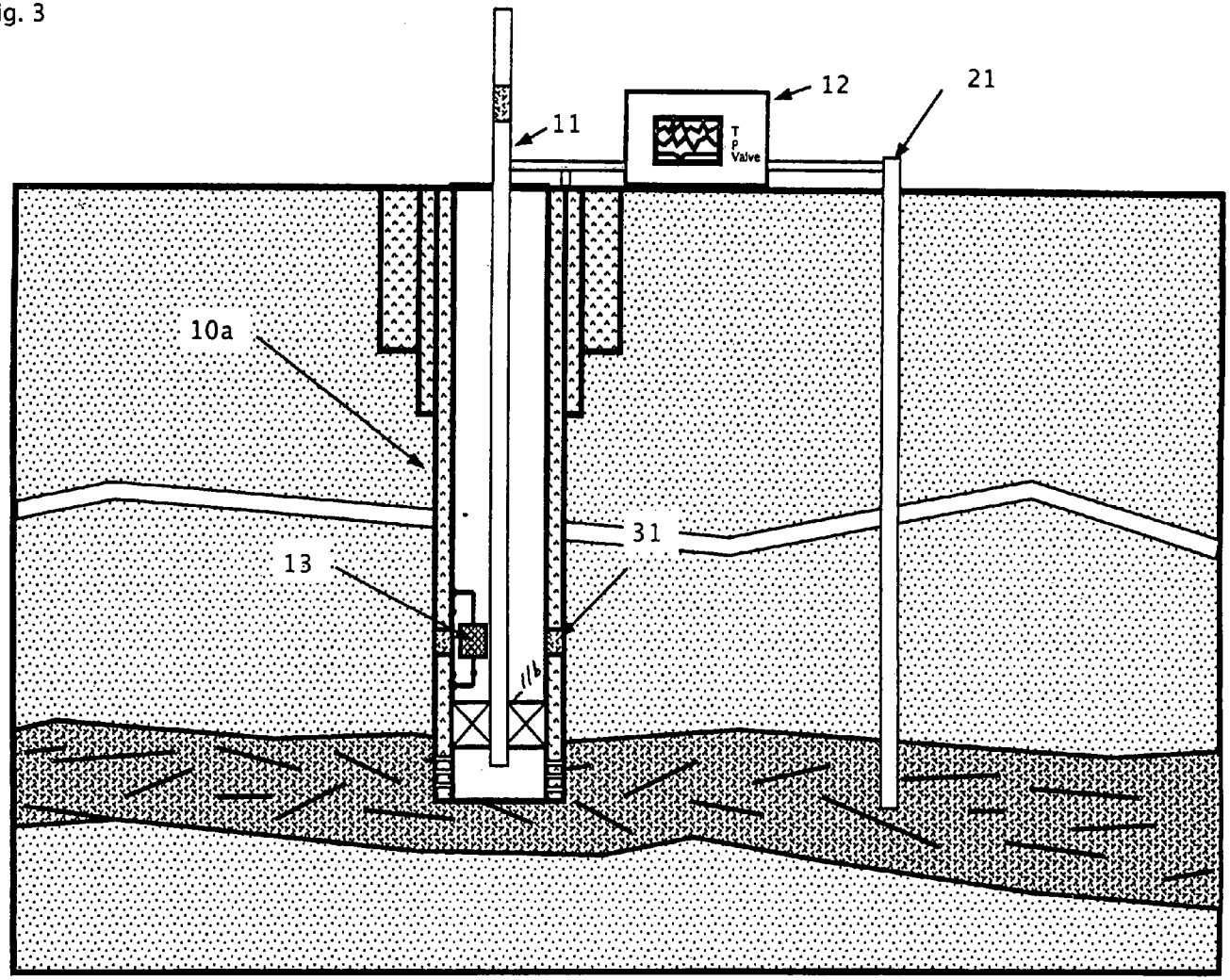
FIG. 3 is a cross-sectional schematic diagram of a drilled well having another embodiment of the present invention in place where portions of the casing are insulated and switching occurs to improve reflected modulation.

Referring now to FIG. 3, there can be seen another embodiment of present invention that provides better modulation of the reflected telemetry signal. Here casing 10*a*, which in this case is electrically conductive, has first and second portions, the first and second portions being separated by insulated portion 31 across which modulated reflector sensor package 13 is connected. Modulated reflector sensor package 13 contains switching capabilities that can either connect or disconnect the sections of casing 10*a* separated by insulated section 31 in accordance with conventional sensor control. This capability of modulated reflector sensor package 13 to effect this fast switching allows additional modulation match or mis-match due to the significant change in the effective antenna length of casing 10*a*. Such a change in antenna length is beneficial for modulated reflectance technology, as it provides an excellent method for providing the required modulation of the reflected signal.

Figure 4:
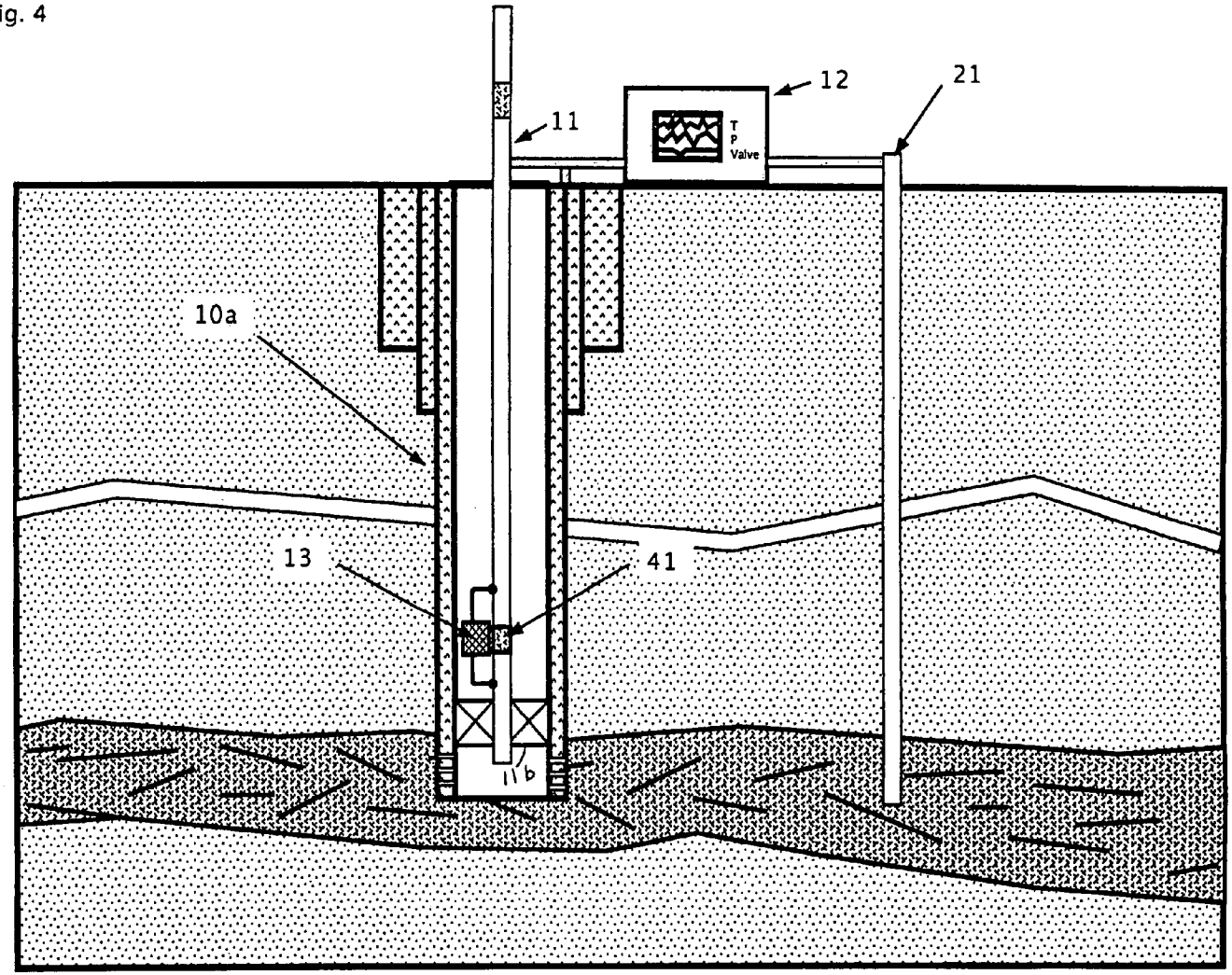
FIG. 4 is a cross-sectional schematic diagram of a drilled well where portions of the pipe string are insulated and switching occurs to improve reflected modulation.

FIG. 4 illustrates another method of providing the additional modulation. Here, pipe string 11 defines first and second portions, the first and second portions being separated by insulated portion 41. Now, modulated reflector sensor package 13 is connected across insulated portion 41, and contains the switching capabilities that allow the connection or disconnection of first and second portions of pipe string 11. Again, this capability of modulated reflector sensor package 13 to effect this fast switching allows additional modulation match or mis-match due to the significant change in the effective antenna length of pipe string 11.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A modulated well telemetry apparatus comprising:

an electrically conductive pipe extending from above ground surface to a point below said surface inside a casing;

an electrical conductor located at a position a distance from said first electrically conductive pipe and extending from above said ground surface to a point below said surface;

modulated reflector sensor apparatus located below said surface for reflecting data on said well;

a RF transceiver located at said surface connected between said electrically conductive pipe and said electrical conductor, for transmitting a RF signal that is confined between said electrically conductive pipe and said electrical conductor to said modulated reflector sensor apparatus, and for receiving a signal modulated with well data and reflected by said modulated reflector apparatus.

2. The apparatus as described in claim 1, wherein said electrical conductor is small diameter pipe in a hole dug by water well drilling apparatus.

3. The apparatus as described in claim 1, wherein said electrical conductor is small diameter pipe in a preexisting hole located near said first electrically conductive pipe.

4. The apparatus as described in claim 1, wherein said electrical conductor is an existing nearby electrically conductive pipe.

5. The apparatus as described in claim 1, wherein said electrically conductive pipe defines a first portion and a second portion, said first and second portions being separated by an insulated portion, and said modulated reflector and sensor apparatus is connected across said insulated portion, and further comprises switching means for providing a connection between said first and second portions of said first electrically conductive pipe, and disconnecting said connection in accordance with sensor input to provide increased modulation of the signal reflected from said modulated reflector and sensor apparatus.

6. A modulated well telemetry apparatus comprising:

an electrically conductive pipe extending from above ground surface to a point below said surface inside an electrically conductive casing;

an electrical conductor located at a position a distance from said electrically conductive pipe and extending from above said ground surface to a point below said surface;

modulated reflector sensor apparatus located below said surface for reflecting data on said well;

a RF transceiver located at said surface connected between said electrically conductive pipe and said electrically conductive casing, and said electrical conductor, for transmitting a RF signal that is confined between said electrically conductive pipe and said electrically conductive casing, and said electrical conductor, and to said modulated reflector sensor apparatus, and for receiving a signal modulated with well data and reflected by said modulated reflector apparatus.

7. The apparatus as described in claim 6, wherein said electrical conductor is small diameter pipe in a hole dug by water well drilling apparatus.

8. The apparatus as described in claim 6, wherein said electrical conductor is small diameter pipe in a preexisting hole located near said electrically conductive pipe.

9. The apparatus as described in claim 6, wherein said electrical conductor is an existing nearby electrically conductive pipe.

10. The apparatus as described in claim 6, wherein said electrically conductive casing defines a first portion and a second portion, said first and second portions being separated by an insulated portion, and said modulated reflector, and sensor apparatus is connected across said insulated portion of said electrically conductive casing, and further comprises switching means for providing a connection across said insulated portion and disconnecting said connection in accordance with sensor input to provide increased modulation of the signal reflected from said modulated reflector and sensor apparatus.

* * * * *